US005960237A

United States Patent [19]

Toyoshi et al.

[11] Patent Number: 5,960,237

[45] Date of Patent: Sep. 28, 1999

[54] APPARATUS AND METHOD FOR REMOVING FOREIGN MATERIALS LODGED INSIDE AN IMAGE FORMING SYSTEM

[75] Inventors: Naoki Toyoshi, Toyohashi; Hitoshi Sekino, Toyokawa, both of Japan

[73] Assignee: Minolta Co., Ltd., Osaka, Japan

[21] Appl. No.: 08/970,861

[22] Filed: Nov. 14, 1997

[30] Foreign Application Priority Data

Nov. 15, 1996 [JP] Japan ..... 8-304820

[51] Int. Cl.[6] ..... G03G 15/01; G03G 15/08; G03G 21/00

[52] U.S. Cl. ..... 399/226; 399/284

[58] Field of Search ..... 399/226, 227, 399/228, 279, 284

[56] References Cited

U.S. PATENT DOCUMENTS

| | | | |
|---|---|---|---|
| 4,020,788 | 5/1977 | Brooke | 399/284 X |
| 4,131,359 | 12/1978 | Honda | 399/123 |
| 4,891,674 | 1/1990 | Seyfried | 399/228 |
| 4,920,916 | 5/1990 | Mizuno et al. | 399/284 |
| 4,922,301 | 5/1990 | Katoh et al. | 399/227 |
| 4,958,191 | 9/1990 | Yamada et al. | 399/226 |
| 5,168,319 | 12/1992 | Kimuro et al. | 399/227 |
| 5,243,395 | 9/1993 | Koike et al. | 399/226 |
| 5,587,783 | 12/1996 | Nakamura et al. | 399/227 X |

FOREIGN PATENT DOCUMENTS 04221977 2/1992 Japan .

OTHER PUBLICATIONS

New CS–Technologies Technical Guide #9258–4108–01, Minolta, pp. 1–20, May 1998.

*Primary Examiner*—Fred L. Braun
*Attorney, Agent, or Firm*—Morrison & Foerster LLP

[57] ABSTRACT

The invention provides image forming method and apparatus. One embodiment of the invention is an image forming apparatus with a developing device. This apparatus also includes: (1) an electrostatic latent image carrier on which an electrostatic latent image is formed, (2) a developing roller rotatably driven in a first direction during developing, (3) a developing-roller-reverse rotator which rotates the developing roller in a second direction opposite the first direction, when the developing device moves with respect to the electrostatic latent image carrier. Another embodiment is an image forming apparatus that also includes a developer-regulating member positioned in direct contact with or close proximity to the developing roller. In this embodiment, the rotation of the developing roller in the second direction dislodges materials stuck between the developing roller and the developer-regulating member. Yet another embodiment of the invention an image forming apparatus that also includes a developing device, an electrostatic latent image carrier, a developing roller, and a developer-regulating member. This embodiment further includes a separating member coupled to at least one of the developing-regulating member and the developer roller. The separating member moves the developer-regulating member and the developing roller away from each other when the developing device moves.

10 Claims, 8 Drawing Sheets

* SAME AS DEVELOPER – REGULATING MEMBER
54 – TONER REGULATING BLADE
55 – TONER RESERVOIR
5
5Bk
5C
52C
51C
5a
52M
51M
5M
52Y
51Y
5Y
T
56
2
DRIVE ROLLER – 51Bk
SLACK AREA – 521
DEVELOPING SLEEVE – 52Bk
DRIVE ROLLER + DEVELOPING SLEEVE = DEVELOPING ROLLER
*

MONOCHROME PRINTER

APPARATUS AND METHOD FOR REMOVING FOREIGN MATERIALS LODGED INSIDE AN IMAGE FORMING SYSTEM

BACKGROUND OF THE INVENTION

1. Field of the Invention

The invention relates to image forming method and apparatus.

2. Description of the Related Art

In an electrophotographic color image forming apparatus, an image corresponding to an original document image is generally formed on a recording member in the following manner. A charging device charges a photosensitive member or other such electrostatic latent image carrier. Image exposure is then carried out on the charged area for individual colors such as cyan, yellow, magenta, or black to form an electrostatic latent image which corresponds to an original document image.

Thereafter, a developing device accommodating color toners corresponding to each color image is used to accomplish developing to form a toner image. Each time a toner image for a single color is formed, the toner image is transferred to a transfer belt or other such intermediate transfer member.

Once a toner image of each color has been transferred to the intermediate transfer member so as to form a multi-layered toner image on the intermediate transfer member, this multi-layered toner image is transferred to a recording member by a transfer device. A fixing device then fuses the image on the recording member to obtain a desired image. In a monochrome image forming apparatus, a toner image of a single color is formed on an electrostatic latent image carrier as described above, and this toner image is transferred directly to a recording member and fixed thereon.

Conventional developing devices, which develop an electrostatic latent image formed on an electrostatic latent image carrier to produce a toner image and are used in the image forming apparatuses, accommodate a developer containing a toner and stored in a tank in the developing device. The developer is transported to a developing area by a rotating developing roller in direct contact with or close proximity to the electrostatic latent image carrier. The electrostatic latent image on the electrostatic latent image carrier is then developed by electrostatic absorption.

A conventional developing device often possesses a developer-regulating member in direct contact with, or close proximity to, the developing roller. The developer-regulating member adjusts the quantity and thickness of the developer retained on the developing roller and transported to the developing area, or, additionally, electrically charges the developer.

In developing devices possessing a developer-regulating member, however, any paper debris or other such foreign material present in the developer, or the developer itself, sometimes lodges between the developing roller and the developer-regulating member. Such blockage damages the developing roller, produces blank streaks in the toner layer on the developing roller, or causes the toner to fuse to the developing roller.

Consequently, there is a need for image forming apparatus and method that eliminate the above-identified disadvantages. In particular, there is a need for an image forming apparatus which affords stable image formation by removing material lodged between a developing roller and a developer-regulating member. There is also a need for an image forming apparatus capable of periodic removal of material lodged between a developing roller and a developer-regulating member. In addition, there is a need for an image forming apparatus capable of easily removing materials lodged between a developing roller and a developer-regulating member.

SUMMARY OF THE INVENTION

The invention provides image forming method and apparatus. One embodiment of the invention is an image forming apparatus with a developing device. This apparatus also includes: (1) an electrostatic latent image carrier on which an electrostatic latent image is formed, (2) a developing roller rotatably driven in a first direction during developing, (3) a developing-roller-reverse rotator which rotates the developing roller in a second direction opposite the first direction, when the developing device moves with respect to the electrostatic latent image carrier. Another embodiment is an image forming apparatus that also includes a developer-regulating member positioned in direct contact with or close proximity to the developing roller. In this embodiment, the rotation of the developing roller in the second direction dislodges materials stuck between the developing roller and the developer-regulating member.

Another embodiment of the invention is an image forming apparatus that also includes a developing device, an electrostatic latent image carrier, a developing roller, and a developer-regulating member. This embodiment further includes a separating member coupled to at least one of the developing-regulating member and the developer roller. The separating member moves the developer-regulating member and the developing roller away from each other when the developing device moves.

BRIEF DESCRIPTION OF THE DRAWINGS

The novel features of the invention are set forth in the appended claims. However, for purpose of explanation, several embodiments of the invention are set forth in the following figures.

In the following description, like parts are designated by like reference numbers.

DETAILED DESCRIPTION OF THE INVENTION

The invention provides image forming method and apparatus. In the following description, numerous details are set forth for purpose of explanation. However, one of ordinary skill in the art would realize that the invention may be practiced without the use of these specific details. In other instances, well-known structures and devices are shown in block diagram form in order not to obscure the description of the invention with unnecessary detail.

Figure 1:
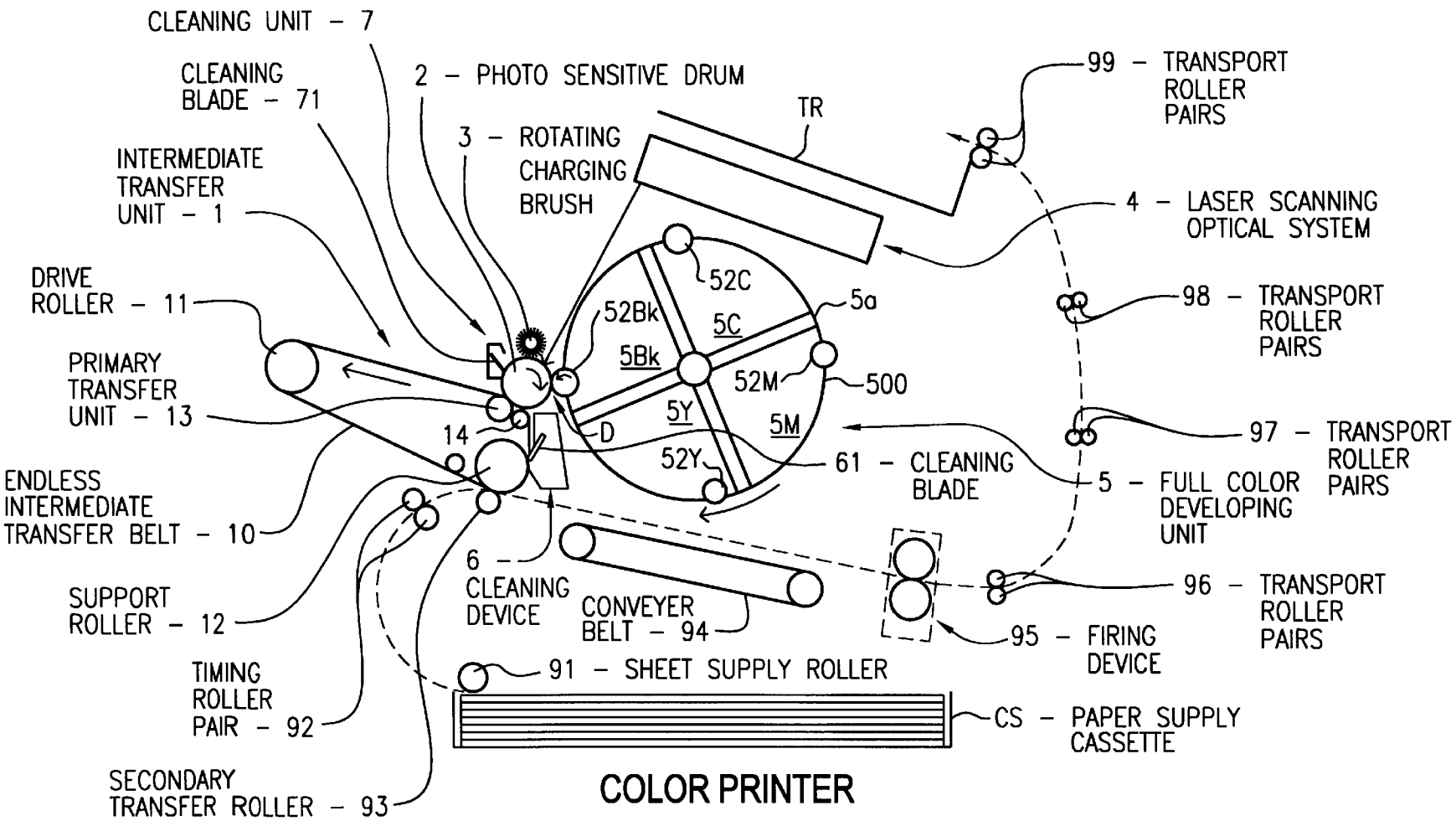
FIG. 1 is a block diagram of a color laser printer.
Figure 2:
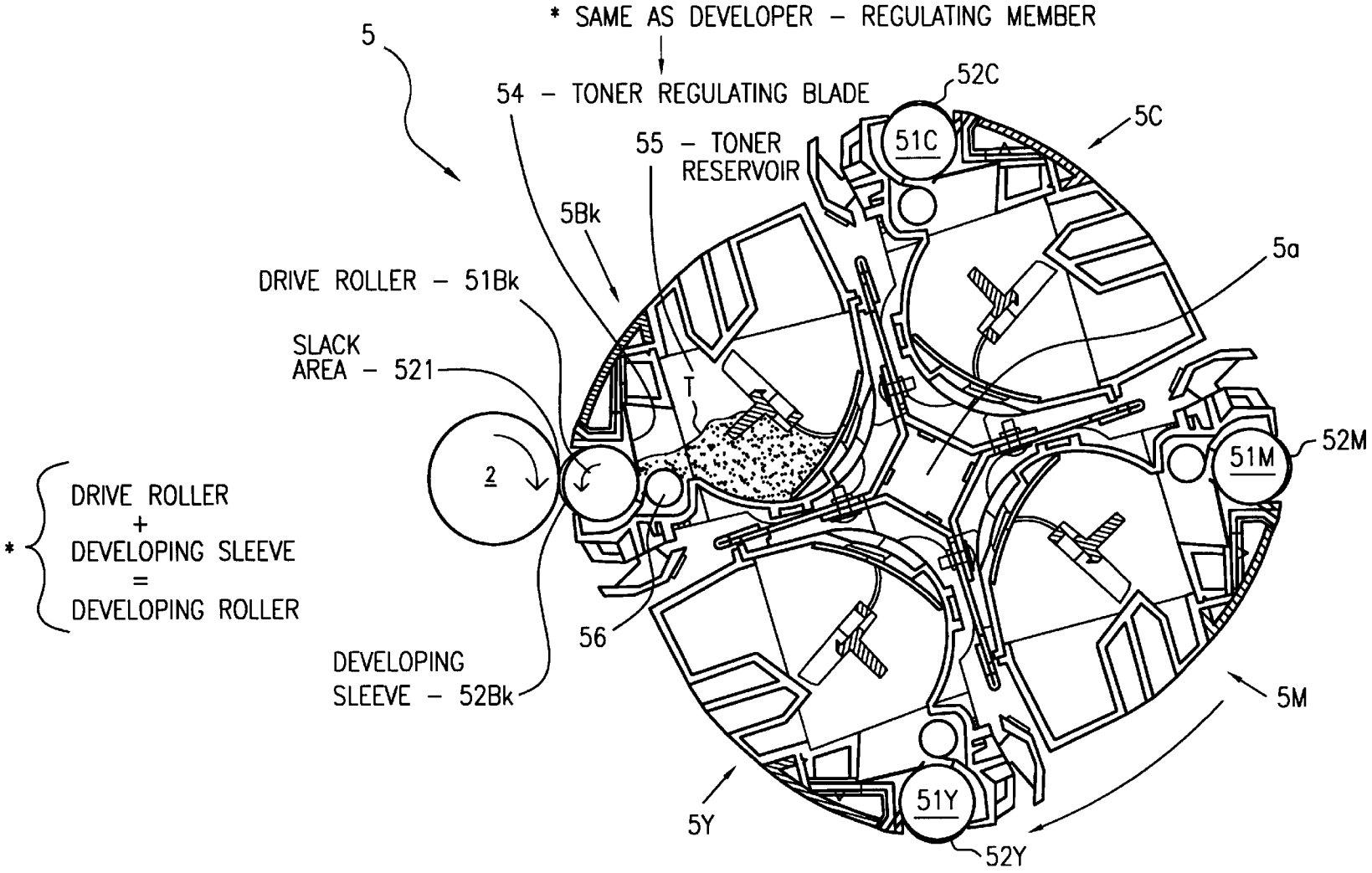
FIG. 2 is a block diagram showing an enlargement of a developing unit and photosensitive member.

FIG. 1 presents the internal structure of a color printer of one embodiment of the invention, while FIG. 2 presents a photosensitive member and a developing unit used in this printer. As shown in these figures, the printer includes photosensitive drum 2, laser scanning optical system 4, full color developing unit 5, intermediate transfer unit 1, paper supply cassette CS, rotating charging brush 3, and cleaning unit 7 with cleaning blade 71.

In the embodiment of the invention shown in these figures, photosensitive drum 2 is rotatably driven in a clockwise direction. In addition, rotating charging brush 3, full color developing unit 5, intermediate transfer unit 1, and cleaning unit 7 are sequentially arranged around this photosensitive drum. Rotating charging brush 3 contacts photosensitive drum 2 directly. While rotatably driven, this brush is subjected to a charging voltage from a power source (not illustrated). Consequently, the brush uniformly charges the surface of photosensitive drum 2.

The laser scanning optical system 4 includes such commonly known components as a laser diode, polygonal mirror, and f-[theta] optical element. Image data corresponding to individual colors of cyan (C), magenta (M), yellow (Y), and black (Bk) are input to a control unit (not illustrated) of laser scanning optical system 4 by a computer or other host device to which the printer is connected. Through the space between rotating charging brush 3 and developing unit 5, laser scanning optical system 4 illuminates photosensitive drum 2 with a laser beam corresponding to image data for each color. In this manner, an electrostatic latent image corresponding to each color is formed on the surface of photosensitive drum 2.

In developing unit 5, four color-differentiated developing devices 5C, 5M, 5Y, and 5Bk are attached to developing rack 500. These developing devices respectively contain a developer which includes a cyan (C), magenta (M), yellow (Y), or black (Bk) toner. The developing unit 5 has a radial structure and is rotated clockwise, with support axis 5*a* serving as the axis point. Consequently, each developing device can be positioned at developing location D confronting photosensitive drum 2.

The construction of black developing device 5Bk is described below with reference to FIG. 2. The following description also pertains to developing devices for other colors (5C, 5M, and 5Y). Black developing device 5Bk is provided with a drive roller 51Bk, and a drive system (described below) to rotatably drive the roller counterclockwise during developing.

Drive roller 51Bk is inserted in developing sleeve 52Bk, whose interior diameter is somewhat larger than the exterior diameter of the roller. The ends of developing sleeve 52Bk are pressed into contact with drive roller 51Bk from behind by a pressure guide (not illustrated). On the opposite side, direct pressure creates slack area 521 in developing sleeve 52Bk, and slack area 521 flexibly contacts photosensitive drum 2. Developing sleeve 52Bk is also in direct contact with toner-regulating blade 54, which is a developer-regulating member.

As drive roller 51Bk is rotatably driven, developing sleeve 52Bk is rotated with corresponding motion. A developing bias voltage is also applied to developing sleeve 52Bk by a power source (not illustrated). In one embodiment of the invention, drive roller 51Bk and developing sleeve 52Bk comprise a developing roller.

Toner reservoir 55 is provided at the rear of developing sleeve 52Bk and contains a monocomponent developer which includes black toner T. Rotating toner supply roller 56 is provided at toner reservoir 55 to supply toner T to developing sleeve 52Bk.

Figure 3:
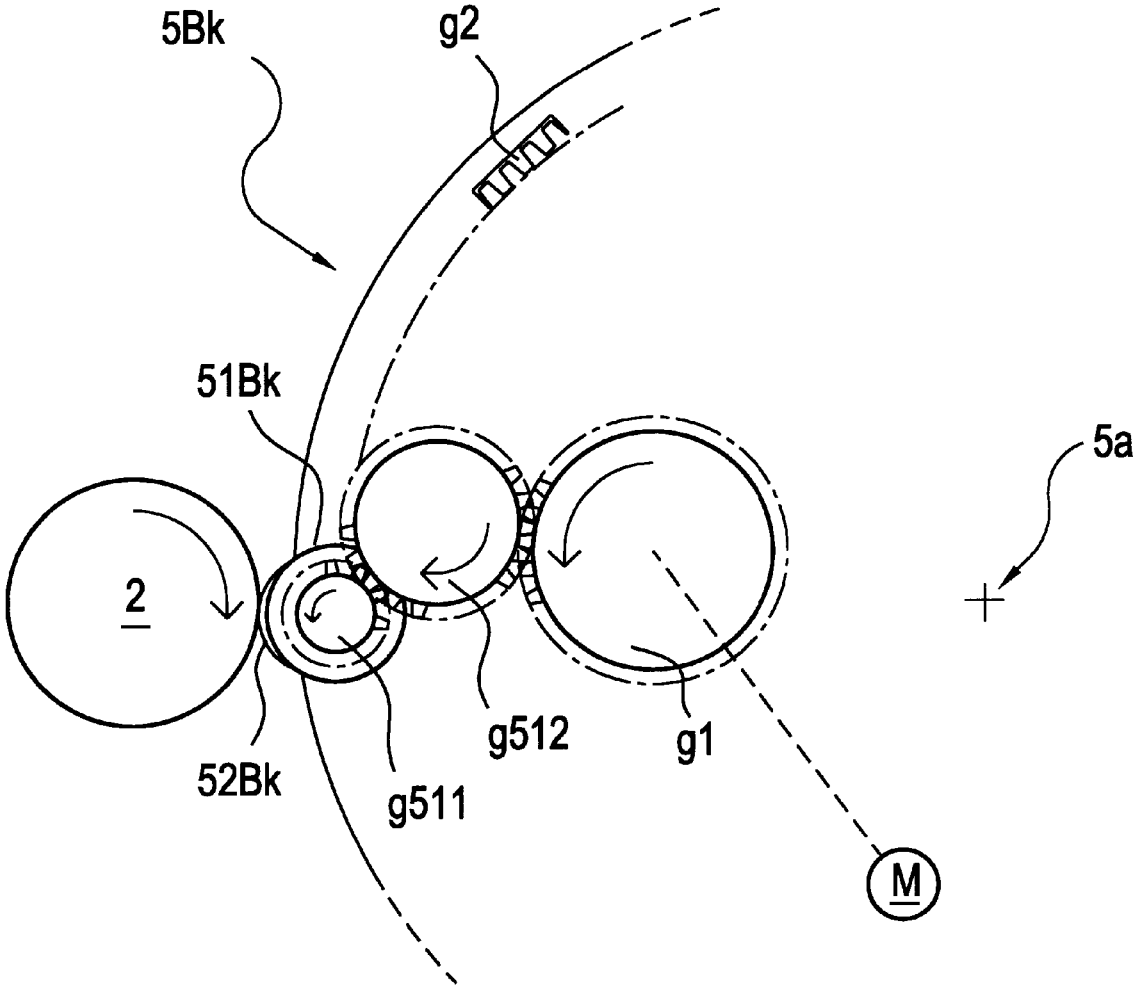
FIG. 3 is a diagram showing a portion of a drive system which drives a developing sleeve inside an individual developing device.

The foregoing description is similar for the developing devices accommodating developers of other colors. In other words, cyan developing device 5C, magenta developing device 5M, and yellow developing device 5Y possess developing sleeves 52C, 52M, and 52Y respectively, and the developing sleeves are respectively inserted in drive rollers 51C, 51M, and 51Y. As the drive rollers are rotatably driven, the developing sleeves are rotated with corresponding motion. FIG. 3 presents a portion of a transmission mechanism which rotates a drive roller in a developing sleeve. As shown in this figure, drive roller 51Bk correspondingly rotates developing sleeve 52Bk of black developing device 5Bk and is provided with gear g511 having an identical rotational axis. Gear g512 is connected to gear g511. Gear g511 and gear g512 are provided in black developing device 5Bk. Other developing devices (5C, 5M, and 5Y) also possess similar gears. When developing unit 5 rotates about a center of supporting axis 5*a*, these gears rotate as a unit with their respective developing device.

The printer unit is equipped with developing roller drive motor M as well as gear g1 connected to motor M via a gear train (not illustrated). Gear g1 is positioned so as to engage a gear atop a developing device (i.e., gear g512 of black developing device 5Bk in FIG. 3) at the developing position. By means of these gears, motor M rotates drive roller 51Bk which correspondingly rotates developing sleeve 52Bk. Gear g1 is also a component used commonly by each developing device (5C, 5M, 5Y, and 5Bk); the gear g1 is positioned at a fixed location in the printer unit, and does not move even as developing unit 5 rotates centrally about supporting axis 5*a*.

Near the path of movement for gear g512, a stationary rack gear g2 is provided in the printer unit. Consequently, as developing unit 5 rotates centrally about supporting axis 5*a*, rack gear g2 engages with gear g512 moving about the aforementioned position of rack gear g2, and gear g512 is rotated. Rack gear g2 is used commonly by each developing device (5C, 5M, 5Y, and 5Bk) and can rotate gear g512 of black developing device 5Bk moving about the interface with rack gear g2, as well as gear g512 in other developing devices (5C, 5M, 5Y). Rack gear g2 does not collide with gear g511 atop a developing device and is provided at a position allowing the gear to engage with gear g512. For these reasons, gear g512 is also made thicker than gear g511.

As shown in FIG. 1, intermediate transfer unit 1 is provided with an endless-type intermediate transfer belt 10. Intermediate transfer belt 10 is wound around drive roller 11, support roller 12, and auxiliary belt pressure roller 14. This belt is rotatably driven counterclockwise in FIG. 1 by a drive system (not illustrated) synchronously with photosensitive drum 2.

A projection (not illustrated) is provided on a side of intermediate transfer belt 10. A microswitch detects this projection and controls exposure, developing, transfer, and other such processing of the image created. Intermediate transfer belt 10 is also supported in a freely rotatable manner and pressed into contact with photosensitive drum 2 by primary transfer roller 13, to which a transfer voltage is applied. This contact region forms a primary transfer area, and individual color toner images formed on photosensitive drum 2 are transferred to intermediate transfer belt 10 by the application of a transfer voltage to primary transfer roller 13.

Secondary transfer roller 93 has a construction affording contact pressure to intermediate transfer belt 10 at the area supported by support roller 12. This contact region forms a secondary transfer area, and secondary transfer roller 93 can be brought into direct contact with intermediate transfer belt 10 or retracted from contact with intermediate transfer belt 10 as needed by a mechanism (not illustrated).

Secondary transfer roller 93 can apply a transfer voltage by means of a power source (not illustrated). When a recording member passes between intermediate transfer belt 10 and secondary transfer roller 93 in contact with the belt, the transfer voltage transfers to the recording member a toner image formed on intermediate transfer belt 10 in a manner described later.

Cleaning device 6 is furnished in the interval extending from the secondary transfer area to the primary transfer area along the direction of motion for the surface of intermediate transfer belt 10. Cleaning device 6 possesses cleaning blade 61, which scraps off the residual toner on intermediate transfer belt 10 when it comes into direct contact with the region of intermediate transfer belt 10 supported by support roller 12. In cleaning device 6, cleaning blade 61 can be brought into direct contact with intermediate transfer belt 10 or retracted from contact with intermediate transfer belt 10 as needed by a mechanism (not illustrated).

A recording member (e.g., a transfer sheet), to which a toner image is transferred, is stored in paper supply cassette CS. Sheet supply roller 91 allows transport of the stored recording member one sheet at a time. Timing roller pair 92 is positioned in the transit path (illustrated in FIG. 1 by the dotted line) of the recording member, and the roller pair supplies the recording member to the secondary transfer area synchronously with a toner image on intermediate transfer belt 10.

Positioned on the downstream side of the secondary transfer area in the transit path of the recording member are (1) a conveyer belt 94 which transports to fixing device 95 a recording member bearing a transferred toner image, (2) a fixing device 95 which heat-fixes a toner image on the recording member, (3) a transport roller pairs 96, 97, and 98, and (4) a discharge roller pair 99. Discharge tray TR stores the recording member ejected by discharge roller pair 99.

A color printing operation by the printer will now be described. A printing operation starts when a printing start button (not illustrated) provided on the printer is pressed. When a printing operation begins (first image color formation), secondary transfer roller 93 and cleaning blade 61 of cleaning device 6 are separated from intermediate transfer belt 10. At such time, black developing device 5Bk confronts developing location D. When the printing operation begins, a developing device switching operation is initiated, developing unit 5 is rotated centrally about support axis 5*a*, and yellow developing device 5Y is switched to developing location D.

Figure 4:
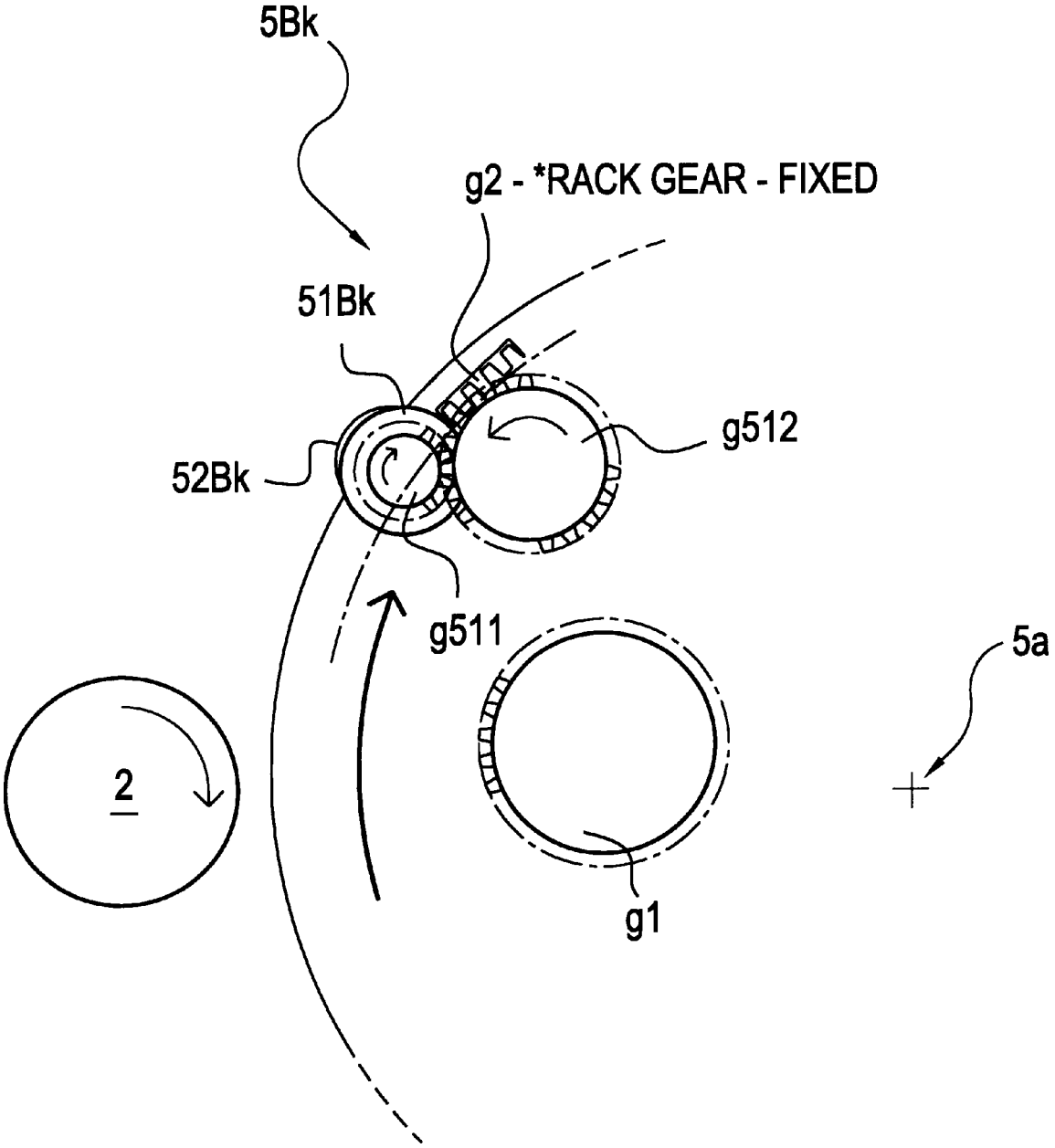
FIG. 4 is a diagram illustrating the state of a developing sleeve rotated in a direction opposite the rotation direction during developing.

During switching of the developing device, gear g512 of black developing device 5Bk moving centrally about support axis 5*a* engages with rack gear g2 provided at a fixed position as shown in FIG. 4, and gear g512 rotates counterclockwise as shown in the figure. The counterclockwise rotation of gear g512 rotates developing sleeve 52Bk clockwise in the figure, opposite the direction during developing, and foreign material lodged between developing sleeve 52Bk and toner-regulating blade 54 is removed. The amount of rotation (rotational angle) of developing sleeve 52Bk at such time may be suitably adjusted by means of the length of rack gear g2.

When a printing operation starts, photosensitive drum 2 is rotatably driven clockwise, intermediate transfer belt 10 is rotatably driven counterclockwise, and the surface of photosensitive drum 2 is charged to a given potential by rotating charging brush 3. Next, laser scanning optical system 4 exposes an initial yellow image, and an electrostatic latent image corresponding to the yellow image is formed on photosensitive drum 2.

This electrostatic latent image is developed by developing sleeve 52Y rotatably driven counterclockwise in the figure by motor M. In developing sleeve 52Y, the developer regulating blade within yellow developing device 5Y then carries out charging while a thin developer layer is maintained at a given thickness, and a developing bias voltage is applied. The developed yellow toner image on photosensitive drum 2 is transferred onto intermediate transfer belt 10 by primary transfer roller 13 at the primary transfer area. Residual toner on photosensitive drum 2 is removed by cleaning blade 71 of cleaning device 7 and is not transferred to intermediate transfer belt 10.

When the first color (yellow) transfer is completed, a developing device switching operation is carried out, and developing device 5M confronts the developing position. During this developing device switching operation, a sequence similar to that previously described is executed, and materials lodged between the toner-regulating blade and developing sleeve 52Y of developing device 5Y are removed.

Magenta image exposure, developing, and primary transfer is then carried out. Subsequently, switching to cyan developing device 5C, cyan image exposure, developing, and primary transfer, and switching to black developing device 5Bk, black image exposure, developing, and primary transfer, are carried out in a similar fashion. Consequently, toner images of each color are superimposed one upon another on intermediate transfer belt 10 for each primary transfer of an individual color, and an overlay toner image is formed on intermediate transfer belt 10. In addition, materials lodged between the toner-regulating blade and developing sleeve 52M of magenta developing device 5M are removed during switching to cyan developing device 5C, and materials lodged between the toner-regulating blade and developing sleeve 52C of cyan developing device 5C are removed during switching to black developing device 5Bk.

When primary transfer for the final color (black) is complete, secondary transfer roller 93 and cleaning blade 61 are brought into direct contact with intermediate transfer belt 10. At such time, the recording member is sent to the secondary transfer area, and the overlay toner image formed on intermediate transfer belt 10 is transferred to the recording member by secondary transfer roller 93, to which a transfer voltage is applied. Once secondary transfer is complete, secondary transfer roller 93 is separated from intermediate transfer belt 10, and residual toner on intermediate transfer belt 10 is scraped off by cleaning blade 61 and is not transferred to the recording member at the secondary transfer area. Thereafter, cleaning blade 61 is separated from intermediate transfer belt 10 and prepared for subsequent image formation.

In the printer described above, a developing device switching operation is used such that material lodged between a developing sleeve and a toner-regulating blade are removed by rotating a developing sleeve in a direction opposite that during developing. Thus, fusion of toner to the developing sleeve and damage to the developing sleeve by these materials are avoided. In this embodiment, only one developing sleeve is rotated in a direction opposite the rotation direction during developing when a developing device switching operation takes place. However, a plurality (e.g., 4) of rack gears similar to rack gear g2 may be provided, and every developing sleeve may be rotated in the opposite direction when a developing device switching operation takes place.

Figure 5:
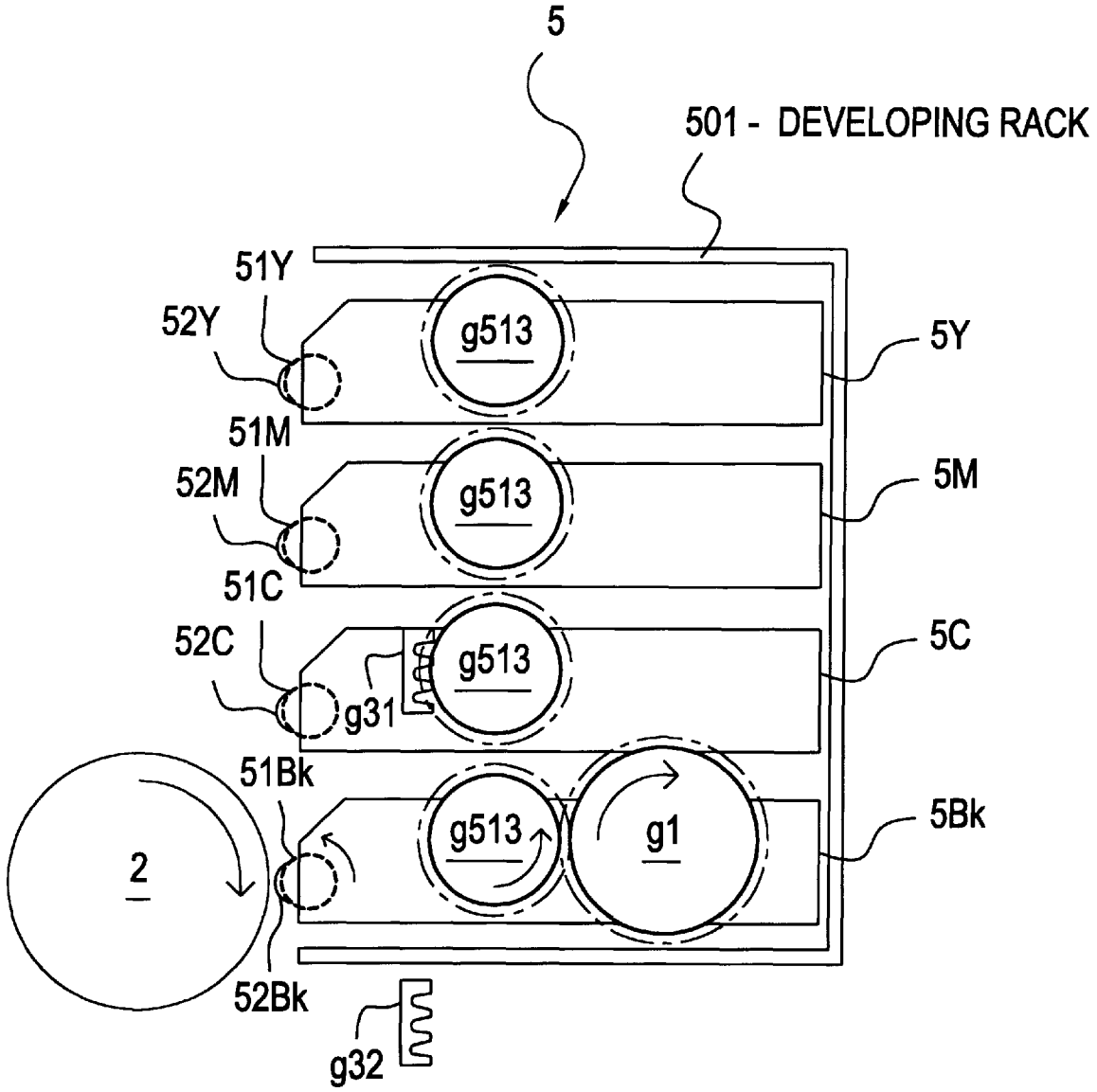
FIG. 5 is a block diagram illustrating a portion of a color printer.
Figure 6:
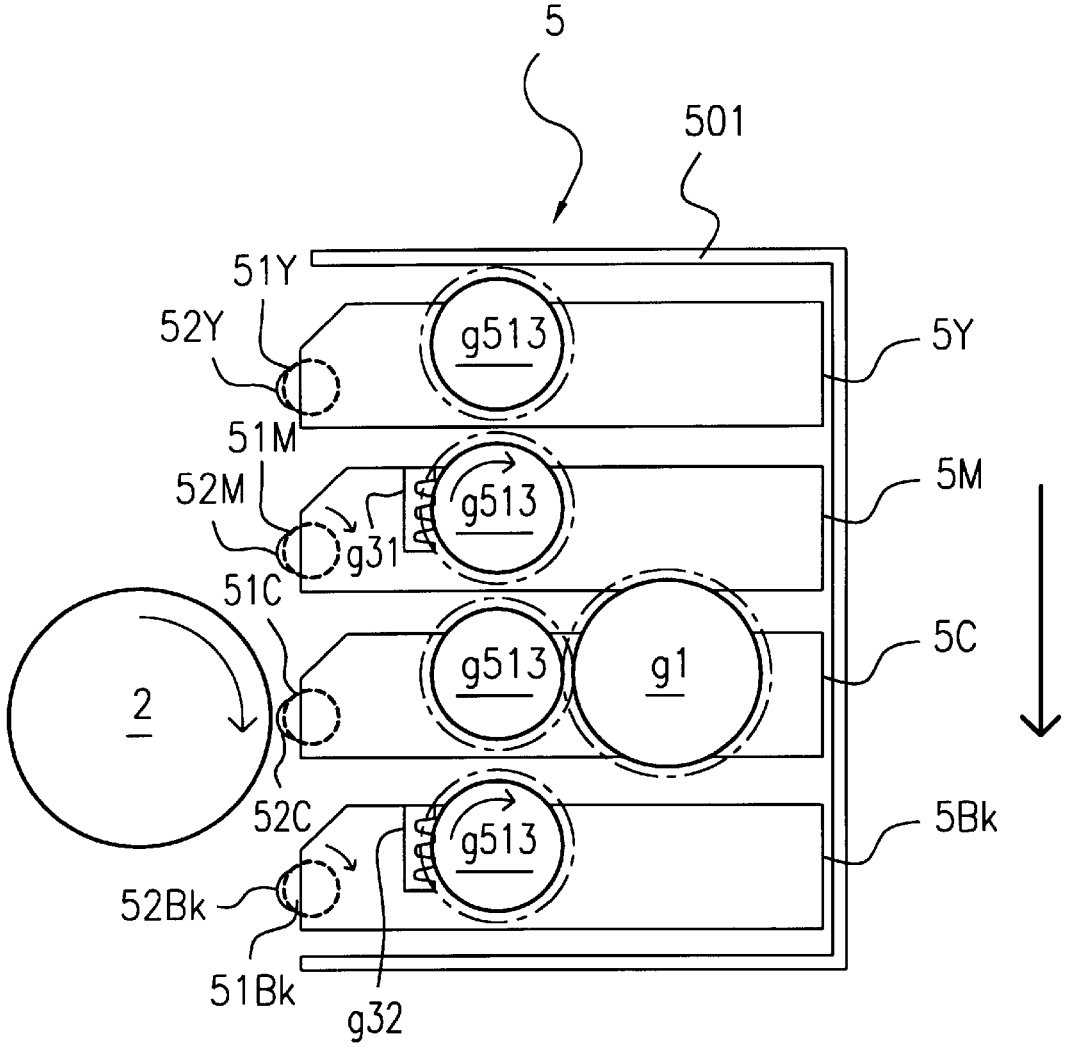
FIG. 6 is a diagram illustrating the state of a developing sleeve in an individual developing device rotated in a direction opposite that during developing.

FIG. 5 presents another embodiment of the invention. This figure illustrates only photosensitive drum 2 and color developing unit 5; other parts are similar to those described in FIG. 1 and are omitted from the description. In developing unit 5, four color-differentiated developing devices 5Y, 5C, 5M, and 5Bk are attached to developing rack 501. Each developing device contains a developer which can include a cyan (C), magenta (M), yellow (Y), or black (Bk) toner. These developing devices have a vertical movement construction (e.g., an elevator construction) and move vertically along developing rack 501, as shown in FIG. 6. Each developing device can also be provided at a developing position which confronts photosensitive drum 2.

The individual developing devices 5Y, 5M, 5C, and 5Bk are akin to those illustrated in FIGS. 1 and 2, and possess developing sleeves 52Y, 52M, 52C, and 52Bk, respectively. During developing, an electrostatic latent image on photosensitive drum 2, rotatably driven clockwise in the embodiment shown in FIG. 5, is developed by the aforementioned developing sleeves, which is rotatably driven counterclockwise in this embodiment. Though not illustrated, a toner in each developing sleeve forms a thin layer of a given thickness and directly contacts a toner-regulating blade employed for electrical charging.

The developing sleeves are rotatably driven by (1) gear g1 which has a fixed position and is driven by way of a gear train (not illustrated) connected to a motor (not illustrated), (2) gear g513 which is provided in each developing unit and which engages with gear g1 when located at the developing position, and (3) a gear train (not illustrated) connected to gear g513. During developing, gear g513 is rotated counterclockwise by gear g1 connected to a motor, and the developing sleeve is rotated counterclockwise. When developing unit 5 moves vertically, fixed position rack gears g31 and g32 are positioned at locations engaging with individual developing device gears g513.

The printer of FIG. 5 also makes use of a developing device switching operation. In particular, when a developing device moves downward in this figure, rack gear g31 or rack gear g32 rotates gear g513 (in FIG. 6, gear g513 of developing device 5M or 5Bk) in a direction opposite the rotation direction during developing. Thus, a developing sleeve is rotated in a direction opposite the rotation direction during developing, and blockage between the developing sleeve and a toner-regulating blade is eliminated.

Figure 7:
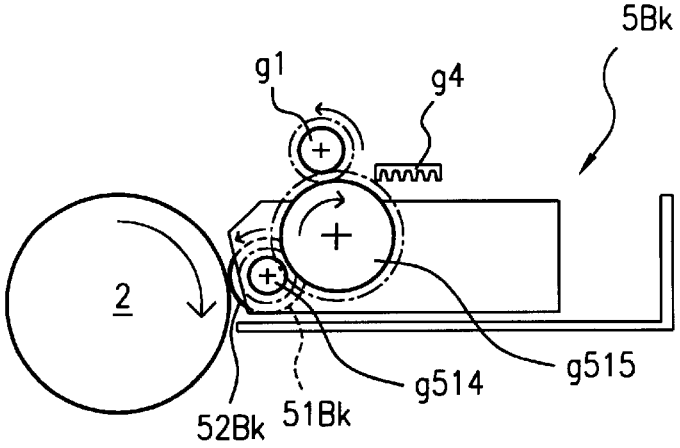
FIG. 7 is a block diagram illustrating part of a monochrome printer.
Figure 8:
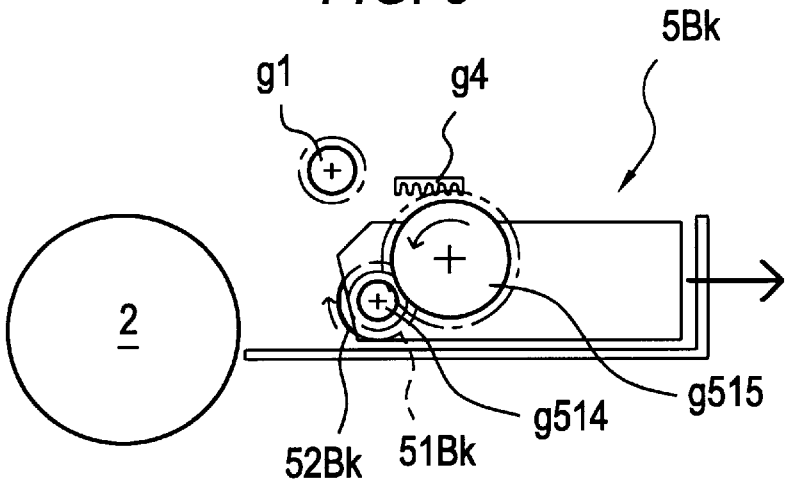
FIG. 8 is a diagram illustrating the state of a developing sleeve rotated in a direction opposite the rotation direction during developing.

FIGS. 7 and 8 illustrate a portion of a monochrome printer which is another embodiment of the invention. Since this printer is a monochrome printer, black developing device 5Bk is furnished as the developing device. The developing device is designed for horizontal movement (sliding type). In addition, for maintenance or other purposes, developing device 5Bk can be moved horizontally, as shown in FIG. 8, to confront photosensitive drum 2 at the developing location, or to separate from photosensitive drum 2.

Developing device 5Bk is similar to the device described in FIG. 5 and possesses developing sleeve 52Bk. During developing, an electrostatic latent image formed on photosensitive drum 2, which is rotatably driven clockwise in FIGS. 7 and 8, is developed by developing sleeve 52Bk, which is rotatably driven counterclockwise in these figure. Though not illustrated, a toner in developing sleeve 52Bk forms a thin layer of a given thickness and directly contacts a toner-regulating blade employed for electrical charging.

Developing sleeve 52Bk is rotated by gear g1 which has a fixed position. Gear g1 is driven by way of a gear train (not illustrated) connected to a motor (not illustrated), and gears g515 and g514 on developing device 5Bk (the gears on the axis of developing sleeve drive roller 51Bk). Gears g514 and g515 engage gear g1 when located at the developing position.

When developing device 5Bk moves horizontally, rack gear g4 is located at a fixed position which engages with gear g515 provided on developing device 5Bk. During maintenance of the printer of FIGS. 7 and 8, the rightward, horizontal movement of developing device 5Bk causes rack gear g4 to rotate gear g515 in a direction opposite the rotation direction during developing (which is counterclockwise in these figure). Thus, developing sleeve 52Bk is rotated in a direction (counter-clockwise in the figures) opposite the rotation direction during developing, and blockage between developing sleeve 52Bk and a toner-regulating blade is eliminated.

In the printer of FIGS. 7 and 8, as in the printer illustrated in FIG. 1, an electrostatic latent image is formed on photosensitive drum 2. This electrostatic latent image is developed by developing device 5Bk, and the developed image on photosensitive drum 2 is transferred directly to a recording member. Additionally, the blockage elimination structure illustrated in FIGS. 7 and 8 can also be applied when the developing device is given the form of a cassette detachable from the body of the image forming apparatus.

In the foregoing examples, blockage between a developing sleeve and a toner-regulating blade in direct contact with the sleeve was removed by rotating the developing sleeve or a developing roller in a direction opposite the rotation direction during developing. However, removal of materials lodged between the developing roller and the developer-regulating member may also be accomplished by moving the developer roller and the developing regulating member away from each other.

Figure 9:
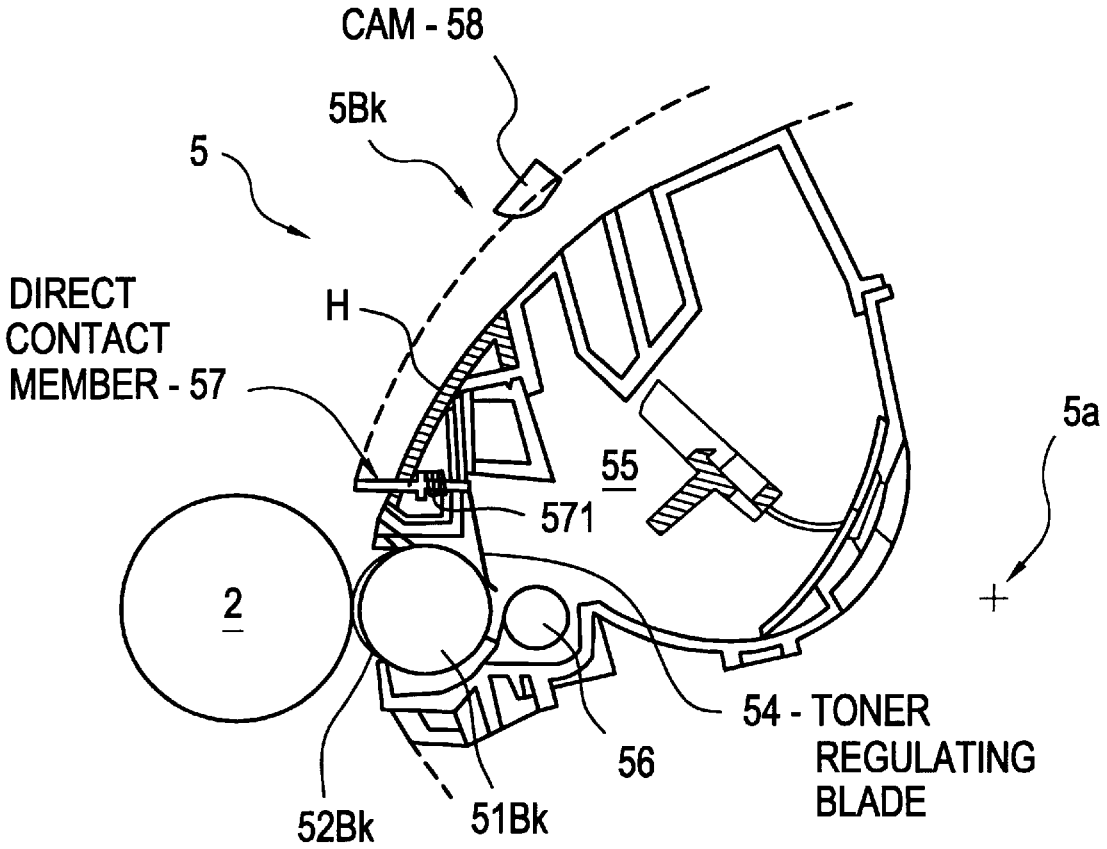
FIG. 9 is a block diagram illustrating a part of a color printer.
Figure 10:
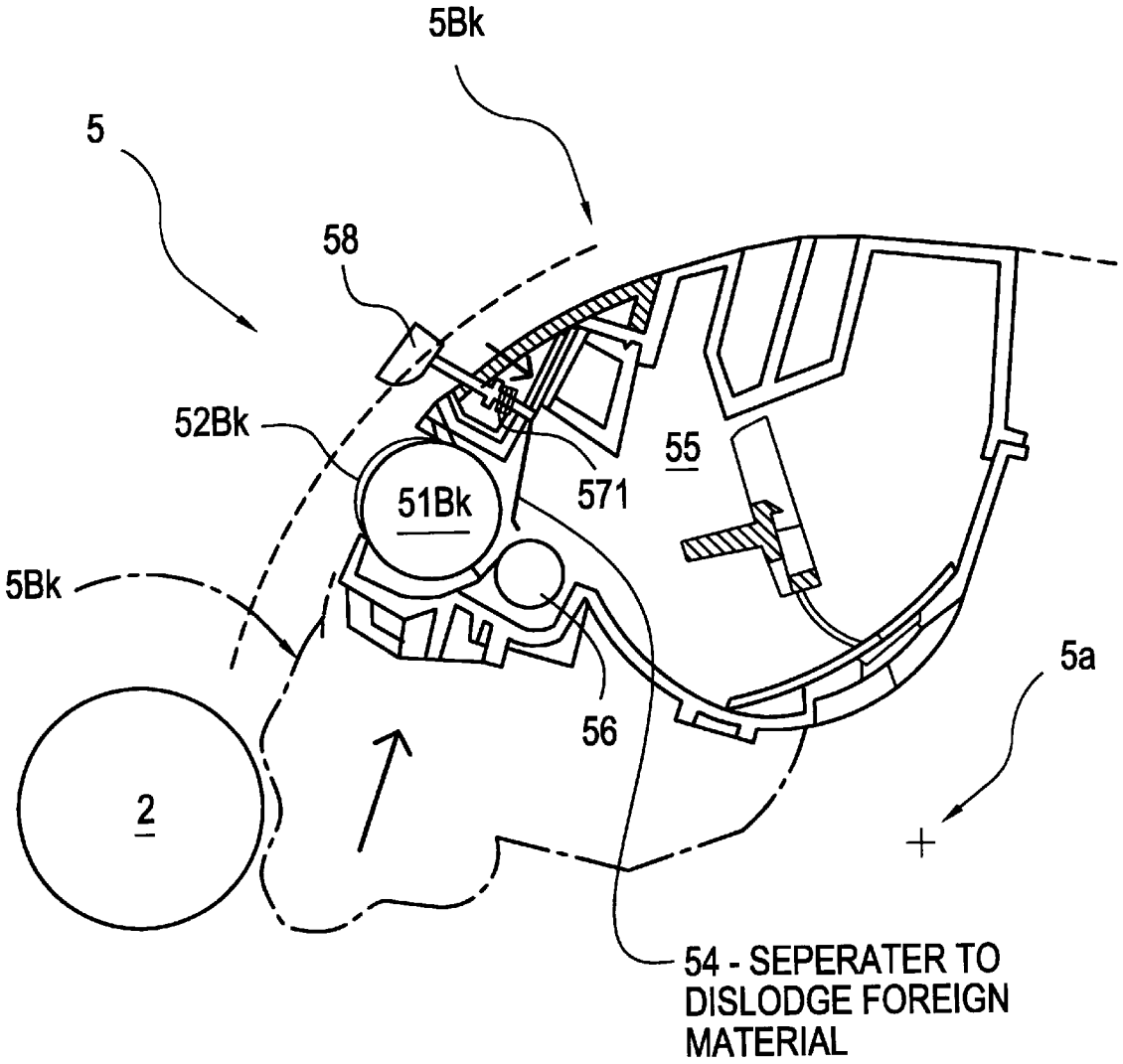
FIG. 10 is a diagram illustrating the state of a toner-regulating blade that has been separated from a developing sleeve.

FIGS. 9 and 10 illustrate a portion of a color printer of another embodiment of the invention. Apart from a portion of the developing device, this printer is similar to the printer illustrated in FIGS. 1 and 2. In the printer of FIGS. 9 and 10, developing unit 5 has a radial form and rotates in a clockwise direction, with support axis 5*a* serving as the point of support. Black developing device 5Bk, a cyan developing device (not illustrated), a magenta developing device (not illustrated), or a yellow developing device (not illustrated) can be positioned at the developing position confronting photosensitive drum 2.

Developing device 5Bk possesses developing sleeve 52Bk. This sleeve 52Bk rotates counterclockwise in the figure during developing, following the movement of drive roller 51Bk. The driver roller is driven by a drive system similar to that described in FIG. 3 and inserted in developing sleeve 52Bk. This sleeve directly contacts toner-regulating blade 54, which electrically charges toner transported to the developing area and creates a designated thin layer of toner. In the developing device, movable, direct-contact member 57 directly contacts toner-regulating blade 54. One end of direct contact member 57 directly contacts toner-regulating blade 54, and the other end of the member extends to the exterior of housing H of developing device 5Bk. Direct contact member 57 is impelled toward the exterior of housing H by spring 571. Other developing devices not illustrated (5C, 5M, 5Y) are also equipped with a direct contact member like that described above.

When developing unit 5 rotates centrally about support axis 5*a* during developing device switching, direct contact member 57 is pressed toward the interior of housing H by cam 58 located at a fixed position, as illustrated in FIG. 10. Thus, toner-regulating blade 54 is separated from developing sleeve Bk52, and foreign material lodged between both elements is thereby removed. A mechanism like that illustrated in FIGS. 9 and 10 which separates the toner-regulating blade from the developing sleeve may also be applied in a device designed for vertical movement, as in FIG. 5, or one designed for horizontal movement, as in FIG. 7.

Although in the foregoing description the invention has been described in terms of its application to a printer, the invention may also be applied to a copying machine or the like. A printer or a copying machine can also be considered an image forming apparatus. The invention is applicable to a first type of image forming apparatus in which a toner image on an electrostatic latent image carrier is developed by a developing device and transferred directly to a recording member (e.g., a monochrome image forming apparatus). The invention is also applicable to a second type of image forming apparatus in which a toner image formed on an electrostatic latent image carrier is transferred to an intermediate transfer member (such as a intermediate transfer belt), and the toner image on the intermediate transfer member is then transferred to a recording member (e.g., a color image forming apparatus).

In either type of image forming apparatus mentioned above, the developing device may be one which carries out either monocomponent developing or two-component developing. A color developing device is acceptable, and a monochrome developing device is also acceptable. The developing roller possessed by the developing device may be one with a literal roller form, in which a developing sleeve with an inner diameter somewhat larger than the outer diameter of a rotatably driven roller is fit onto the roller such that the sleeve is correspondingly rotated. The developing roller retains a developer containing a toner and transports the agent to a developing area, where it is positioned in direct contact with or close proximity to an electrostatic latent image carrier during developing, and is rotatably driven in a given direction. The developer-regulating member creates a thin layer of developer with a given thickness and may also impart a given electrical charge to the developer by frictional charging.

Two examples are provided relating to mechanisms to eliminate blockage at a developer-regulating member through the use of an operation in which a developing device moves in a given direction. First, when two or more developing devices containing toners of respectively different colors are provided, as in a color image forming apparatus, a movement operation is used to replace a developing device confronting an electrostatic latent image carrier by a separate developing device. In such an instance, each individual developing devices possess its own developing roller and developer-regulating member. In addition, in this type of image forming apparatus, a developing roller reverse-rotation means rotates the developing roller in a direction opposite that during developing, and materials lodged between the developing roller and the developer-regulating member are removed.

Second, when a developing device can be separated from a developing position confronting an electrostatic latent image carrier for maintenance or a similar purpose, a movement operation is used to accomplish this separation. In this type of image forming apparatus, a developer-regulating member separation means separates the developer-regulating member from the developing roller by a given distance (when the developer-regulating member is positioned in close proximity to the developing roller, a distance larger than the distance during developing), and materials lodged between the regulating member and the developing roller are removed.

Examples of a developing roller reverse-rotation means and a developer-regulating member separation means include the following. In the first type of developing device described above, when the developing roller in the developing device is rotatably driven in a given direction during developing by a transmission mechanism which transmits the drive power from a drive source (such as a motor), the developing roller reverse-rotation means may be one including a linkage, in which the developing device is linked to the transmission mechanism by a component carried in the developing device. When the developing device moves in a given direction, the developing roller is rotated in a direction opposite that during developing.

Described in further detail, the transmission mechanism is a gear train connected to a drive source, and the developing roller reverse-rotation means is one including a rack gear or other such linkage mechanism which engages with at least one gear carried by the developing device within the gear train. When the developing device moves in the aforementioned given direction, the developing roller is rotated in a direction opposite that during developing.

A developer-regulating member separation means in the above-described second type of developing device may include a movable direct contact member in direct contact with a developer-regulating member provided in the developing device. It may also include a cam or other such linkage mechanism. The cam links to the direct contact member when the developing device moves in a given direction together with the direct contact member, and the cam presses the direct contact member in a direction separating the developer-regulating member from the aforementioned developing roller.

As described above, the embodiments of the invention image forming apparatuses which easily remove materials lodged between their developing rollers and their developer-regulating members. While the invention has been described with reference to numerous specific details, one of ordinary skill in the art would recognize that the invention can be embodied in other specific forms without departing from the spirit of the invention. Thus, one of ordinary skill in the art would understand that the invention is not to be limited by the foregoing illustrative details, but rather is to be defined by the appended claims.

We claim:

1. An image forming apparatus having a developing device, the image forming apparatus comprising:

(a) an electrostatic latent image carrier on which an electrostatic latent image is formed, wherein the developing device moves with respect to the electrostatic latent image carrier;

(b) a developing roller;

(c) a developer-regulating member positioned in direct contact with or close proximity to the developing roller; and (d) a separating member coupled to at least one of the developer-regulating member and the developing roller, the separating member being coupled so as to move the developer-regulating member and the developing roller away from each other in response to the motion of the developing device.

2. The image forming apparatus of claim 1, wherein the separating member separates the developer-regulating member from the developing roller by a predetermined distance.

3. The image forming apparatus of claim 2, wherein the separation of the developing roller and the developer-regulating member dislodges the material stuck between the developing roller and the developer-regulating member.

4. The image forming apparatus of claim 1, wherein the developing roller includes a developing sleeve.

5. An image forming apparatus having a developing device, the image forming apparatus comprising:

(a) an image carrier on which an image is formed, wherein the developing device moves with respect to the image carrier;

(b) a developing roller;

(c) a developer-regulating member positioned in direct contact with or close proximity to the developing roller; and (d) a separating member coupled to at least one of the developer-regulating member and the developing roller, the separating member being coupled so as to move the developer-regulating member and the developing roller away from each other in response to the motion of the developing device.

6. A color image forming apparatus comprising:

(a) an electrostatic latent image carrier on which an electrostatic latent image is formed; and (b) a developing unit having a plurality of developing devices which move with respect to the electrostatic latent image carrier;

(c) wherein at least one developing device has:

(1) a developing roller, wherein, during developing, the developing roller is positioned in contact with, or in proximity to, the electrostatic latent image carrier, (2) a developer-regulating member positioned in direct contact with or close proximity to the developing roller, and (3) a contact member coupled to the developer-regulating member so that when the developing device moves away from the electrostatic latent image carrier, the contact member pushes the developer-regulating member away from the developing roller in response to the motion of the developing device to dislodge material lodged between the developing roller and the developer-regulating member.

7. The apparatus of claim 6, wherein the developing unit has a radial structure, and the developing device moves in a circular path towards and away from the electrostatic latent image carrier.

8. The apparatus of claim 6, wherein the developing unit has a vertical structure, and the electrostatic latent image carrier moves in a vertical path with respect to the developing device.

9. A color image forming apparatus comprising:

(a) an image carrier on which an image is formed; and (b) a developing unit having a plurality of developing devices which move with respect to the image carrier;

(c) wherein at least one developing device has:

(1) a developing roller, wherein, during developing, the developing roller is positioned in contact with, or in proximity to, the image carrier, (2) a developer-regulating member positioned in direct contact with or close proximity to the developing roller, and (3) a contact member coupled to the developer-regulating member so that when the developing device moves away from the image carrier, the contact member pushes the developer-regulating member away from the developing roller in response to the motion of the developing device to dislodge material lodged between the developing roller and the developer-regulating member.

10. In an image processing apparatus having a developing device with a developing roller and a developing-regulating member, a method of removing material lodged between the developing roller and the developer-regulating member comprising the steps of (a) moving the developing device within the image processing apparatus and (b) moving the developing roller and the developer-regulating member away from each other in response to the moving of the developing device.

* * * * *